US010800020B2

(12) United States Patent
Dumelow

(10) Patent No.: US 10,800,020 B2
(45) Date of Patent: Oct. 13, 2020

(54) TENSIONING DEVICE AND METHOD FOR TENSIONING A WORKPIECE

(71) Applicant: Enerpac Tool Group Corp., Menomonee Falls, WI (US)

(72) Inventor: Andrew Dumelow, Morpeth (GB)

(73) Assignee: Enerpac Tool Group Corp., Menomonee Falls, WI (US)

( * ) Notice: Subject to any disclaimer, the term of this patent is extended or adjusted under 35 U.S.C. 154(b) by 29 days.

(21) Appl. No.: 15/599,591

(22) Filed: May 19, 2017

(65) Prior Publication Data

US 2017/0334049 A1 Nov. 23, 2017

Related U.S. Application Data

(60) Provisional application No. 62/338,873, filed on May 19, 2016.

(51) Int. Cl.
*B25B 29/02* (2006.01)
*B25B 29/00* (2006.01)

(52) U.S. Cl.
CPC ..... *B25B 29/02* (2013.01); *B25B 29/00* (2013.01)

(58) Field of Classification Search
CPC ..... B23P 19/067; B25B 29/02; B25B 29/00; B25B 17/02
USPC ..... 81/57.38, 479, 467, 470
See application file for complete search history.

(56) References Cited

U.S. PATENT DOCUMENTS 3,844,533 A * 10/1974 Markiewicz ..... B25B 29/02 254/29 A
4,829,650 A 5/1989 Galard
4,998,453 A * 3/1991 Walton ..... B25B 29/02 81/57.38
5,257,207 A 10/1993 Warren
5,452,629 A * 9/1995 Heiermann ..... B23P 19/067 81/57.38

(Continued)

FOREIGN PATENT DOCUMENTS

EP 2522465 A1 11/2012
EP 2671673 A1 12/2013

(Continued)

OTHER PUBLICATIONS

Examination Report issued from the European Patent Office for related Application No. 17171939.6 dated Jun. 4, 2019 (5 pages).

(Continued)

*Primary Examiner* — Monica S Carter
*Assistant Examiner* — Abbie E Quann
(74) *Attorney, Agent, or Firm* — Michael Best & Friedrich LLP

(57) ABSTRACT

A tensioning device for tensioning a workpiece includes a main body having a chamber, a fluid inlet providing fluid communication between a fluid source and the chamber, a puller member supported in the main body and configured to engage the workpiece, and a piston positioned in the chamber and coupled to the puller member. Movement of the piston moves the puller member along a piston axis in at least a first direction. The tensioning device further includes a sensor coupled to the piston and operative to measure a displacement of the piston and/or the puller member in a direction parallel to the piston axis. The sensor generates a signal indicative of the displacement.

14 Claims, 14 Drawing Sheets

(56) References Cited

U.S. PATENT DOCUMENTS

| | | | | |
|---|---|---|---|---|
| 8,051,745 | B2 * | 11/2011 | Petrak | B60T 11/046 74/500.5 |
| 8,261,421 | B2 | 9/2012 | Monville | |
| 9,248,532 | B2 | 2/2016 | Wagner et al. | |
| 2008/0173140 | A1 | 7/2008 | Hohmann et al. | |
| 2014/0020515 | A1 * | 1/2014 | Hohmann | F16B 31/025 81/57.38 |
| 2014/0165789 | A1 | 6/2014 | Hohmann et al. | |
| 2015/0314431 | A1 * | 11/2015 | Hohmann | B25B 29/02 81/57.38 |

FOREIGN PATENT DOCUMENTS

| | | | |
|---|---|---|---|
| WO | 8605135 | A1 | 9/1986 |
| WO | 2015118283 | A1 | 8/2015 |
| WO | 2015152728 | A1 | 10/2015 |

OTHER PUBLICATIONS

European Patent Office Examination Report for Application No. 17171939.6 dated May 15, 2020 (6 pages).

* cited by examiner

TENSIONING DEVICE AND METHOD FOR TENSIONING A WORKPIECE

CROSS-REFERENCE TO RELATED APPLICATIONS

This application claims priority to prior filed U.S. Provisional Patent Application No. 62/338,873, filed May 19, 2016, the entire contents of which are incorporated by reference.

FIELD

The present disclosure relates to tensioning systems, and specifically to a hydraulic bolt tensioner.

BACKGROUND

Tensioning systems apply tension to one or more bolts to ensure a predetermined clamping force across a joint. Tensioning systems apply an axially load to each bolt (or bolts) to preload the bolt. Mechanical force is applied in an axial direction rather than by applying torque, thereby eliminating inaccuracies caused by friction between a nut and a seating surface.

SUMMARY

In one aspect, a tensioning device for tensioning a workpiece includes a main body having a chamber, a fluid inlet providing fluid communication between a fluid source and the chamber, a puller member supported in the main body and configured to engage the workpiece, and a piston positioned in the chamber and coupled to the puller member. Movement of the piston moves the puller member along a piston axis in at least a first direction. The tensioning device further includes a sensor coupled to the piston and operative to measure a displacement of at least one of the piston and the puller member in a direction parallel to the piston axis. The sensor generates a signal indicative of the displacement.

In another aspect, a method for tensioning a workpiece includes: engaging a puller member with a portion of the workpiece; applying pressure to a piston coupled to the puller member to move the puller member in a first direction parallel to a piston axis; sensing a linear displacement of the piston along the piston axis; calculating a tensile load exerted on the workpiece based on the linear displacement of the piston; comparing the calculated tensile load exerted on the workpiece with a predetermined tensile load; and when the calculated tensile load exerted on the workpiece is less than the predetermined tensile load, applying additional pressure to the piston to move the puller member further in the first direction parallel to the piston axis.

In yet another aspect, a tensioning device for tensioning a workpiece includes a main body having a chamber, a fluid inlet providing fluid communication between a fluid source and the chamber, a puller member supported in the main body and configured to engage the workpiece, and a piston positioned in the chamber and coupled to the puller member. Movement of the piston moves the puller member along a piston axis in at least a first direction. The tensioning device further includes a sensor operative to measure a displacement of the piston in a direction parallel to the piston axis. The sensor includes a housing and a movable member supported for movement relative to the housing along a sensor axis substantially parallel to the piston axis. The moveable member is coupled to the piston by an offset arm oriented perpendicular to the piston axis.

Other aspects will become apparent by consideration of the detailed description and accompanying drawings.

DETAILED DESCRIPTION

Before any independent embodiments are explained in detail, it is to be understood that the disclosure is not limited in its application to the details of construction and the arrangement of components set forth in the following description or illustrated in the following drawings. The disclosure is capable of other independent embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware.

However, one of ordinary skill in the art, and based on a reading of this detailed description, would recognize that, in at least one embodiment, aspects of the invention may be implemented in software (for example, stored on non-transitory computer-readable medium) executable by one or more processing units, such as a microprocessor, an application specific integrated circuits ("ASICs"), or another electronic device. As such, it should be noted that a plurality of hardware- and software-based devices, as well as a plurality of different structural components may be utilized to implement the invention. For example, "controllers" described in the specification may include one or more electronic processors or processing units, one or more computer-readable medium modules, one or more input/output interfaces, and various connections (for example, a system bus) connecting the components.

Figure 1:
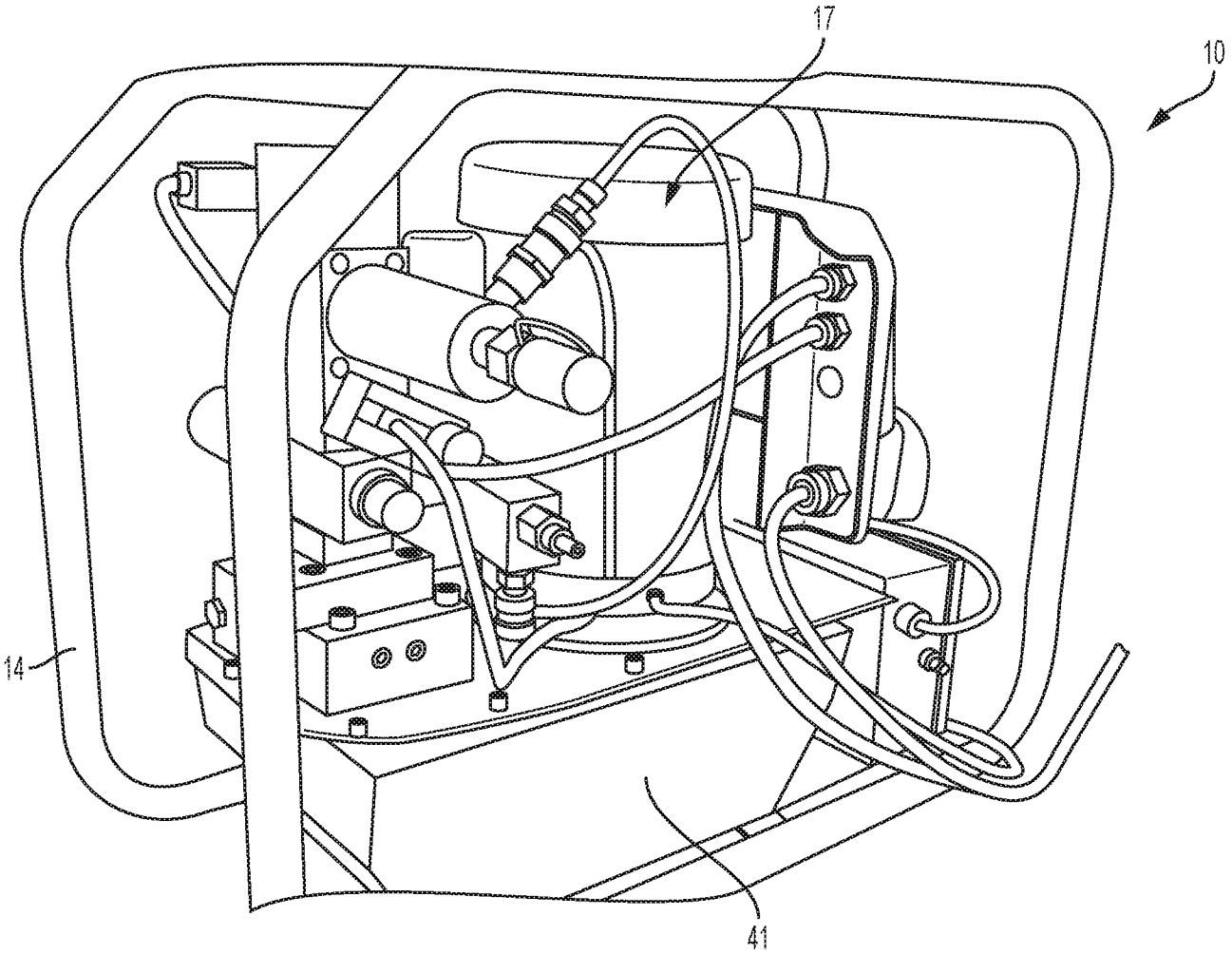
FIG. 1 is a perspective view a hydraulic pump.
Figure 3:
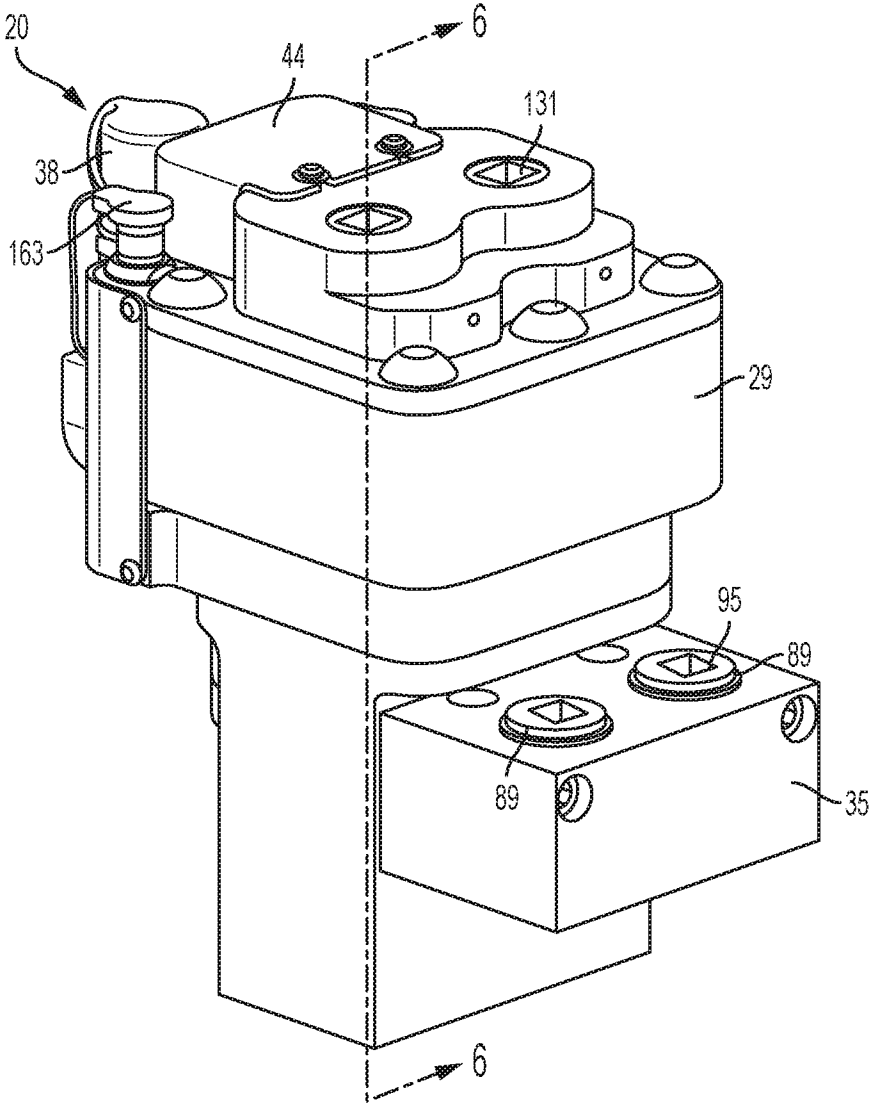
FIG. 3 is a reverse perspective view of the tensioning device of FIG. 2.
Figure 2:
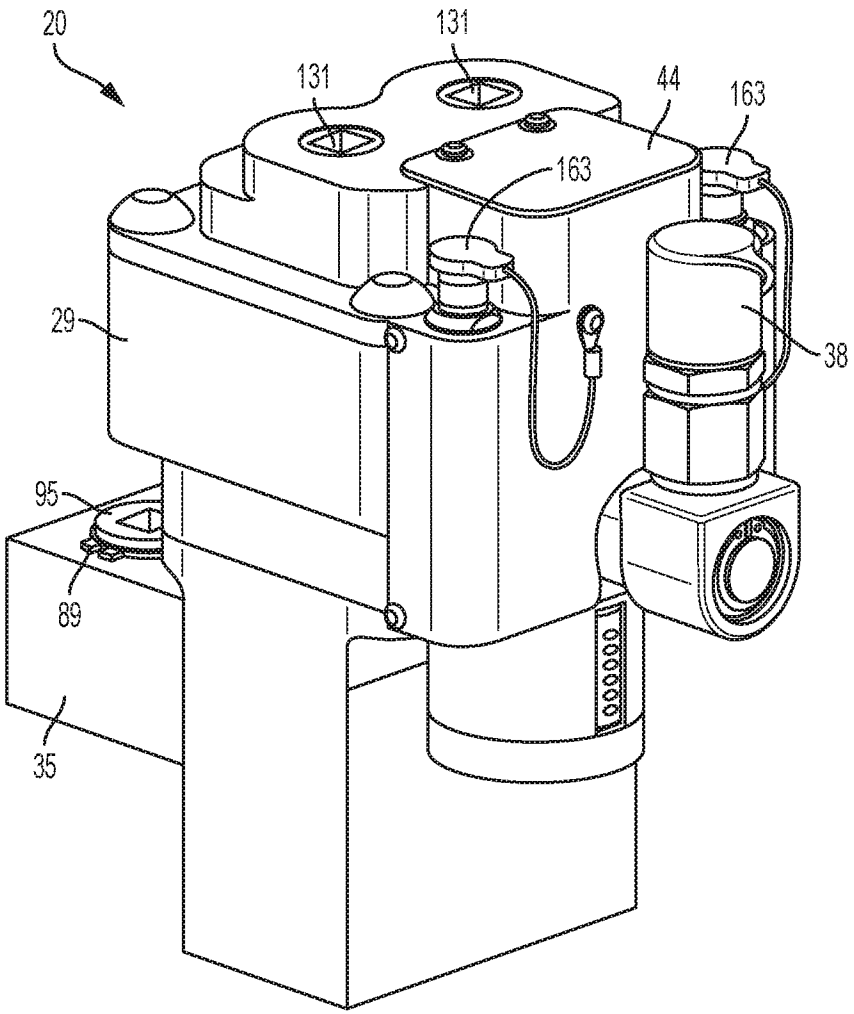
FIG. 2 is a first perspective view of a tensioning device according to one embodiment.

FIG. 1 illustrates a pump system 10 for actuating a tensioning device or tensioner 20 (FIGS. 2 and 3). The pump system 10 includes a frame 14 supporting a fluid reservoir 41 and a pump assembly 17. The pump assembly 17 may be connected to the tensioner 20 via fluid hoses (not shown), and supplies pressurized fluid flow (e.g., hydraulic fluid) to the tensioner 20.

As shown in FIGS. 2 and 3, the tensioner 20 includes a main body 29, a plurality of cylinder assemblies 32 (FIG. 6) disposed within the main body 29, and a gearbox 35 coupled to the main body 29. Further, a fluid inlet 38 extends from the main body 29 and provides fluid communication between the cylinder assemblies 32 and the pump system 10 (FIG. 1). The tensioner 20 also includes a sensor enclosure 44 coupled to the main body 29. In the illustrated embodiment, the tensioner 20 is configured to engage a pair of bolts 26 concurrently (FIG. 4).

Figure 4:
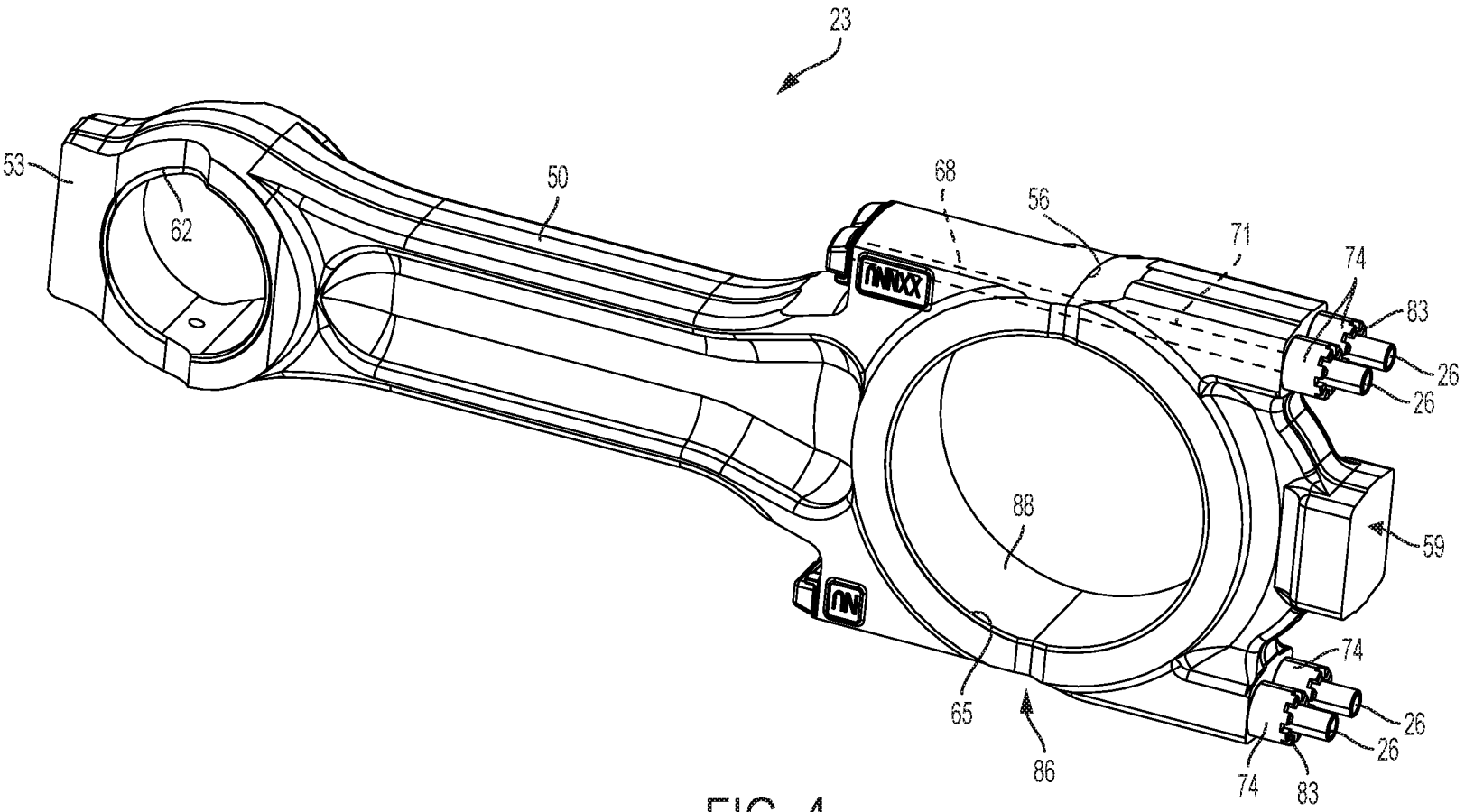
FIG. 4 is a perspective view of a connecting rod.
Figure 5:
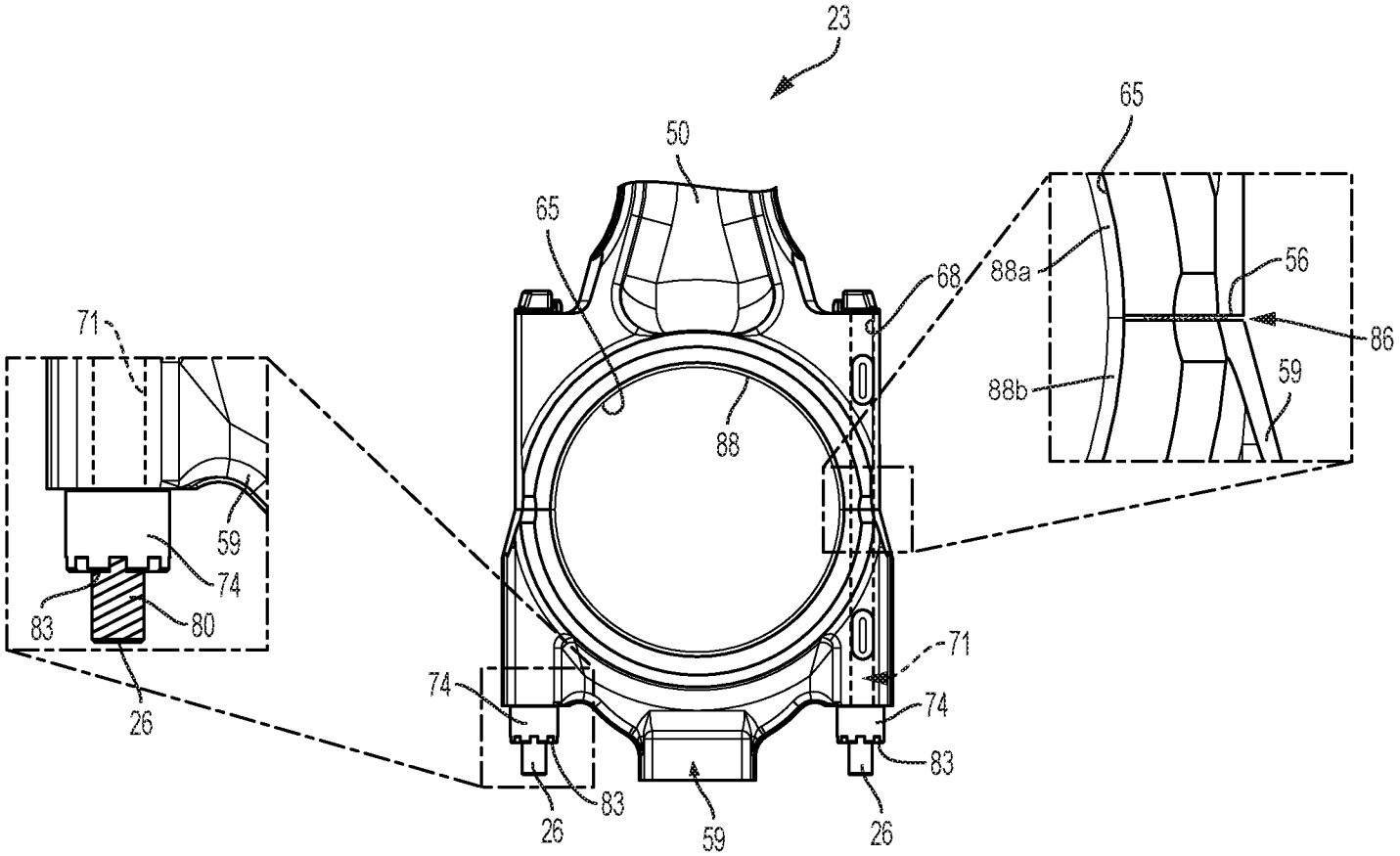
FIG. 5 is an enlarged plan view of a portion of the connecting rod.

With reference to FIGS. 4 and 5, a connecting rod 23 includes a main arm 50 and a cap portion 59 removably coupled to the main arm 50. The main arm 50 includes a first end 53 and a second end 56. The connecting rod 23 defines a first bearing aperture 62 proximate the first end 53 and a second bearing aperture 65 formed when the cap portion 59 is connected to the main arm 50 proximate the second end 56.

Bolts 26 extend through respective apertures 68 in a flange or shoulder of the second end 56 of the main arm 50, and each bolt 26 also extends through a respective aperture 71 of the cap portion 59 when the cap portion 59 is coupled to the main arm 50. Although one aperture 68 and one aperture 71 is shown in FIG. 4, it is understood that each of the illustrated bolts 26 extends through similar apertures 68 and 71. The connecting rod 23 further includes a plurality of nuts 74 that engage the bolts 26 to removably secure the cap portion 59 to the main arm 50. Specifically, each nut 74 includes an internal threaded region 77 (FIG. 8) that threadably engages a corresponding external threaded region 80 of each bolt 26, as shown in FIG. 5. The nuts 74 further include teeth-like castellations 83 to facilitate torque transfer to the nut 74. When the cap portion 59 is secured to the main arm 50 without any tension in the bolts 26, a gap 86 exists between the main arm 50 and the cap portion 59. A bearing 88 is positioned in the second bearing aperture 65. In the illustrated embodiment, the bearing 88 is formed as two mating portions 88*a*, 88*b* that form a ring. Applying tension to the bolts 26 removes the gap 86 and collapses at least a portion of the bearing 88 (referred to as "bearing crush"), thereby providing a press-fit.

Figure 6:
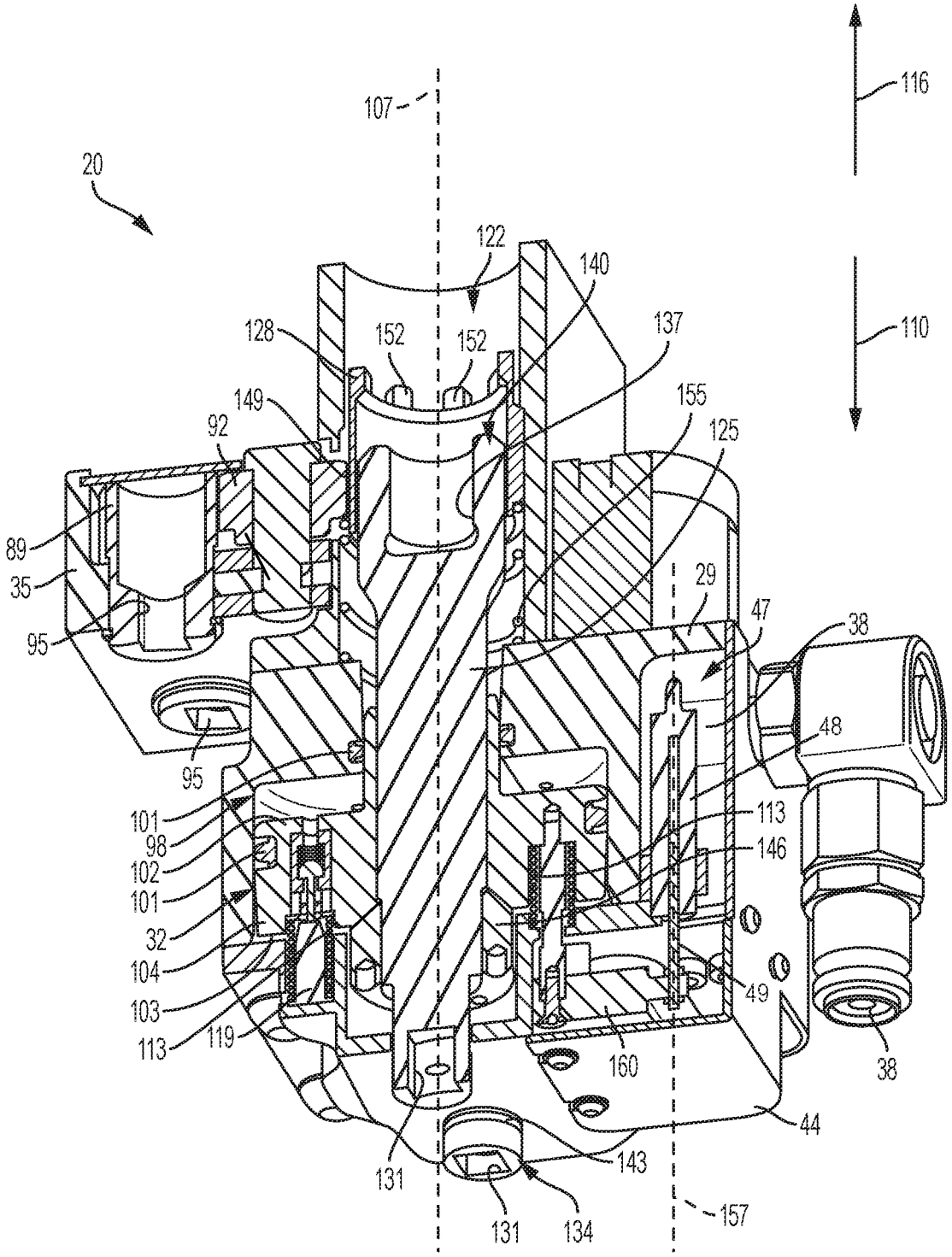
FIG. 6 is a cross-sectional view of the tensioning device of FIG. 3, viewed along section 6-6.

Each of the cylinder assemblies 32 are substantially identical and therefore only one cylinder assembly 32 will be subsequently described for sake of brevity. As shown in FIG. 6, the gearbox 35 includes a drive gear 89 and a driven gear 92 that is driven by the drive gear 89. The drive gear 89 and the driven gear 92 engage each other in a meshed relationship in order to transfer torque therebetween. The drive gear 89 includes a drive socket 95 that receives a tool in order to apply torque (or rotate) the drive gear 89 and the driven gear 92. Although the illustrated embodiments shows the drive socket 95 to be square, in other embodiments, the drive socket 95 can be hex-shaped, star-shaped, or the like.

The cylinder assembly 32 includes a chamber 98 that receives pressurized fluid from the pump system 10 (FIG. 1) via the fluid inlet 38. The cylinder assembly 32 further includes seals 101 to inhibit pressurized fluid from leaking out of the chamber 98, and a piston 104 that moves along a piston axis 107 relative to the main body 29. The piston 104 moves in response to a force differential between sides 102, 103 of the piston 104. In the illustrated embodiment, a first side 102 of the piston 104 is subjected to a force caused by pressurized fluid entering the chamber 98, biasing the piston 104 in a first direction 110. A second side 103 of the piston 104 is biased by a plurality of springs or biasing members 113 in a second direction 116 opposite the first direction 110. When the force exerted by the fluid overcomes the force exerted by the biasing members 113, the piston 104 moves between a first retracted position (FIG. 8) and a second extended position (FIG. 6). In some embodiments, the piston 104 is oval-shaped and has a maximum stroke length of 10 mm between the first position and the second position.

In the illustrated embodiment, a relief valve 119 releases pressure from the chamber 98 when the stroke length of the piston 104 reaches a predetermined amount (e.g., 8.5 mm). In the illustrated embodiment, the relief valve 119 is a Schrader valve. In other embodiments, the relief valve 119 may be a Dunlop valve, a Presta valve, or another type of valve.

Referring again to FIG. 6, each cylinder assembly 32 is associated with a puller assembly 122 including a pulling member 125 for engaging the bolt 26 (FIG. 5). The pulling member 125 moves relative to the main body 29 and the piston 104 in both the first direction 110 and the second direction 116. The pulling member 125 has a first end 134 including a drive socket 131 that receives a tool in order to apply torque to rotate the pulling member 125. The pulling member 125 further includes a second end 140 including a threaded aperture 137 to threadably engage the external threaded region 80 (FIG. 4) of the bolt 26. A visual indicator 143 is positioned proximate the drive socket end 134 and extends around an outer periphery of the pulling member 125. As illustrated, the visual indicator 143 is a line that becomes visible when the piston 104 nears the predetermined stroke length (e.g., 8.5 mm) and provides a visual warning to the operator that the relief valve 119 will release pressure from the chamber 98. Furthermore, a collar 146 is positioned around the pulling member 125 and is disposed between the ends 134, 140. The piston 104 abuts the collar 146 of the pulling member 125 when the piston 104 moves in direction 110, thereby forcing the pulling member 125 to move along the piston axis 107.

A nut-rotating socket 128 is disposed adjacent the second end 140 of the pulling member 125 for engaging the nut 74 (FIG. 4). The socket 128 is capable of axial and rotational movement relative to the pulling member 125. In the illustrated embodiment, the socket 128 has a thin wall and is disposed around the second end 140 of the pulling member 125. The outer periphery of the nut-rotating socket 128 includes teeth 149 that intermesh with the driven gear 92 of the gearbox 35. As such, rotation of the driven gear 92 causes rotation of the nut-rotating socket 128. Additionally, the nut-rotating socket 128 includes teeth-like castellations 152 that intermesh with the castellations 83 (FIG. 5) of the nut 74. The nut-rotating socket 128 is biased toward direction 116 by a spring 155 (e.g., a coil spring) to ensure positive engagement between the castellations 83, 152.

As shown in FIG. 6, the tensioning device 20 further includes sensors 47 (one of which is shown) disposed within the sensor enclosure 44. The sensor 47 is coupled to the cylinder assemblies 32 to operatively measure a magnitude of displacement of the cylinder assemblies 32. Although one sensor 47 is shown, it is understood that the tensioning device includes a sensor for each cylinder assembly 32. Also, in other embodiments, the tensioning device 20 may include fewer or more sensors 47.

Each sensor 47 measures the magnitude of displacement of the associated piston 104. In the illustrated embodiment, the sensor 47 is oriented along a sensor axis 157 that is parallel to the piston axis 107. The sensor 47 may include a housing 48 and a member 49 supported for movement relative to the housing 48 along the sensor axis 157. The sensor 47 (e.g., the sensor member 49) is coupled to the piston 104 via an offset arm 160 such that movement of the piston 104 along the piston axis 107 in either direction 110, 116 is directly translated to the sensor 47.

In the illustrated embodiment, each sensor 47 is a potentiometer. In other embodiments, the sensor 47 may be a linear variable displacement transducer (LVDT), or another type of sensor capable of measuring displacement. The coupling between the sensor 47 and the piston 104 permits the sensor 47 to directly measure a linear displacement of the piston 104, providing highly accurate information regarding the position of the piston 104. The sensor 47 may generate signal indicative of the displacement and transmit the signal to a controller (not shown). Based on the displacement of the piston 104, the tensile load exerted on the bolt 26 may be calculated. Accordingly, the tension experienced by the bolt 26 can be reliably determined based on the displacement of the piston 104 detected by the sensor 47. Based on the signals from the sensor 47, the controller 169 can be programmed to control the pump system 10 as desired (e.g., to increase, decrease, or maintain a current pressure state) to reach a predetermined displacement, and therefore a desired bolt tension.

Figure 6A:
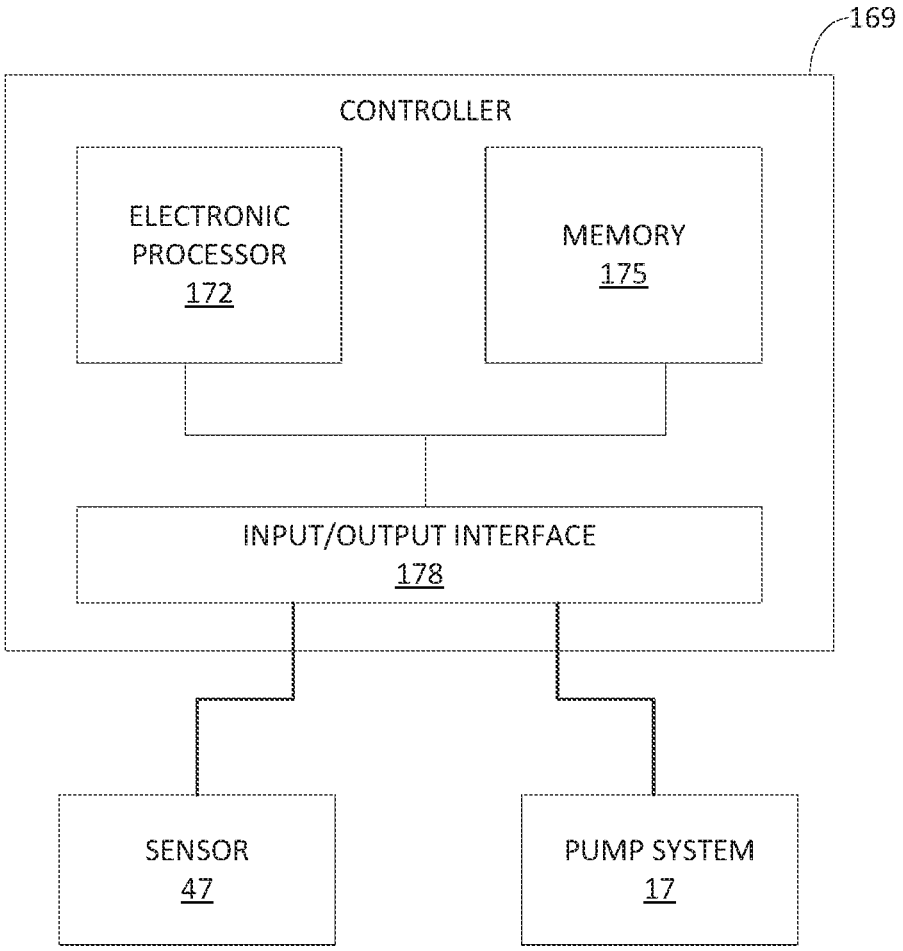
FIG. 6A is a schematic view of a control system.

Each sensor 47 generates a signal corresponding to the magnitude of displacement of the sensor member 49 along the sensor axis 157. As shown in FIG. 6A, the signal is sent to and received/interpreted by an external device or controller 169. In some embodiments, the controller 169 may be positioned on the pump system 10 (FIG. 1); in other embodiments, the controller 169 may be positioned in another location. Also, in the illustrated embodiment, each sensor 47 is in communication with the controller 169 via an electrical connector 163 (FIG. 2) extending from the sensor enclosure 44. In other embodiments, the sensors 47 may communicate with the controller wirelessly. The electrical connectors 163 may also provide electrical power to the sensor 47.

FIG. 2A illustrates one example of the controller 169. As illustrated in FIG. 6A, the controller 169 includes an electronic processor 172 (for example, one or more microprocessors, application specific integrated circuits ("ASICs"), or other electronic devices), a computer-readable, non-transitory memory 175, and an input/output interface 178. It should be understood that the controller 169 may include additional components than those illustrated in FIG. 6A and the configuration of components illustrated in FIG. 6A are provided as only one example. The memory 175 stores instructions executable by the electronic processor 172 to issue commands (for example, through the input/output interface 178). For example, the controller 169 may issue commands to control the flow of pressurized fluid to each piston 104 as described below with respect to FIGS. 9-14. The controller 169 may also use the input/output interface 178 to receive information (for example, axial displacement of the sensor 47) that the controller 169 may use to determine when and what type of commands to issue. For example, in some embodiments, the controller 169 controls the flow of fluid from the pump assembly 17 to the piston 104 based on signals measured, received, or calculated for the tensioner 20. In some embodiments, the controller 169 may receive inputs or commands from a user. It should be understood that the input/output interface 178 may communicate with components external to the controller 169 (for example, the sensor 47, the pump assembly 17, and the like) over a wired or wireless connection, including local area networks and controller area networks.

Figure 7:
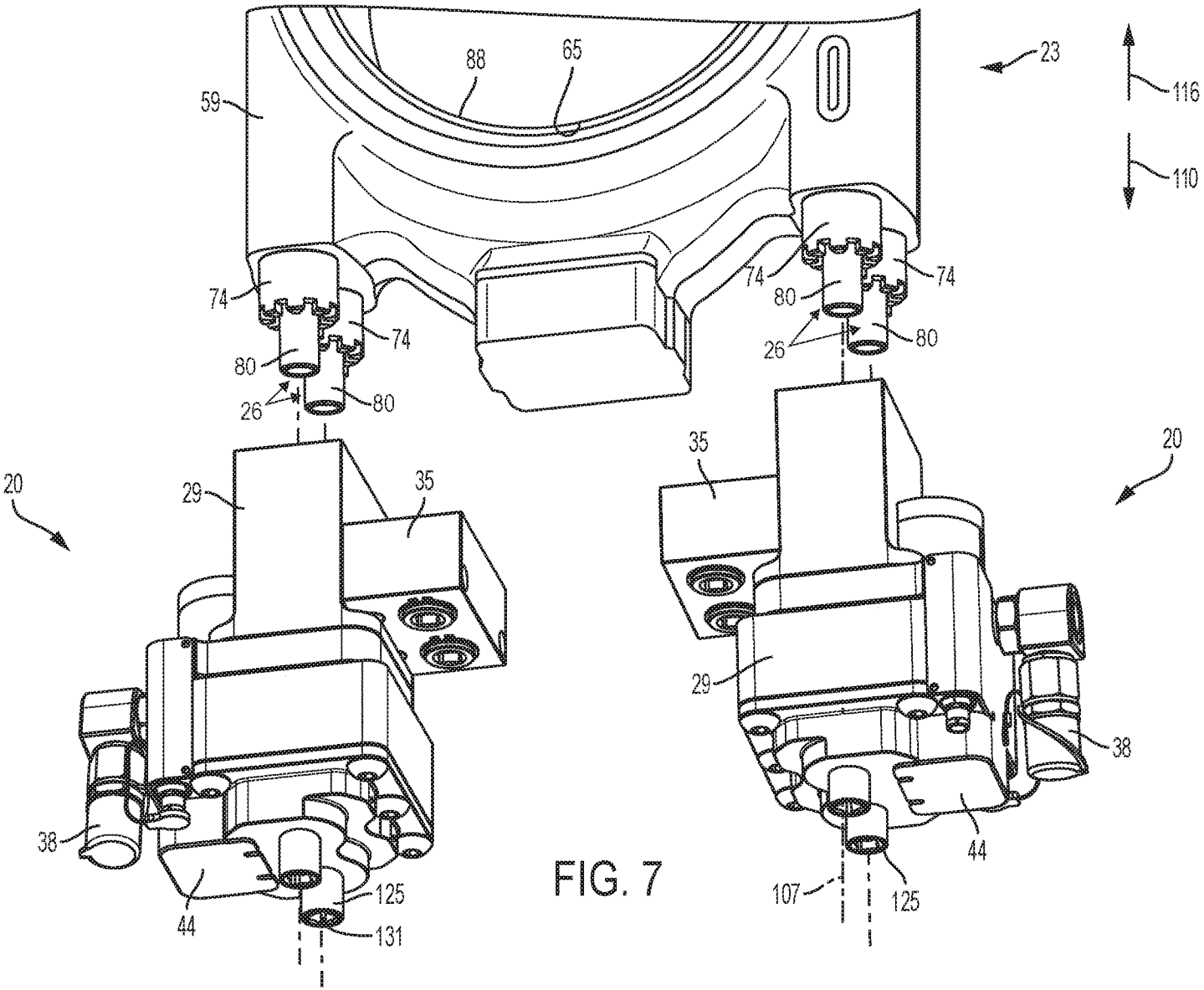
FIG. 7 is a perspective view of a pair of tensioning devices aligned with fasteners of the connecting rod.
Figure 8:
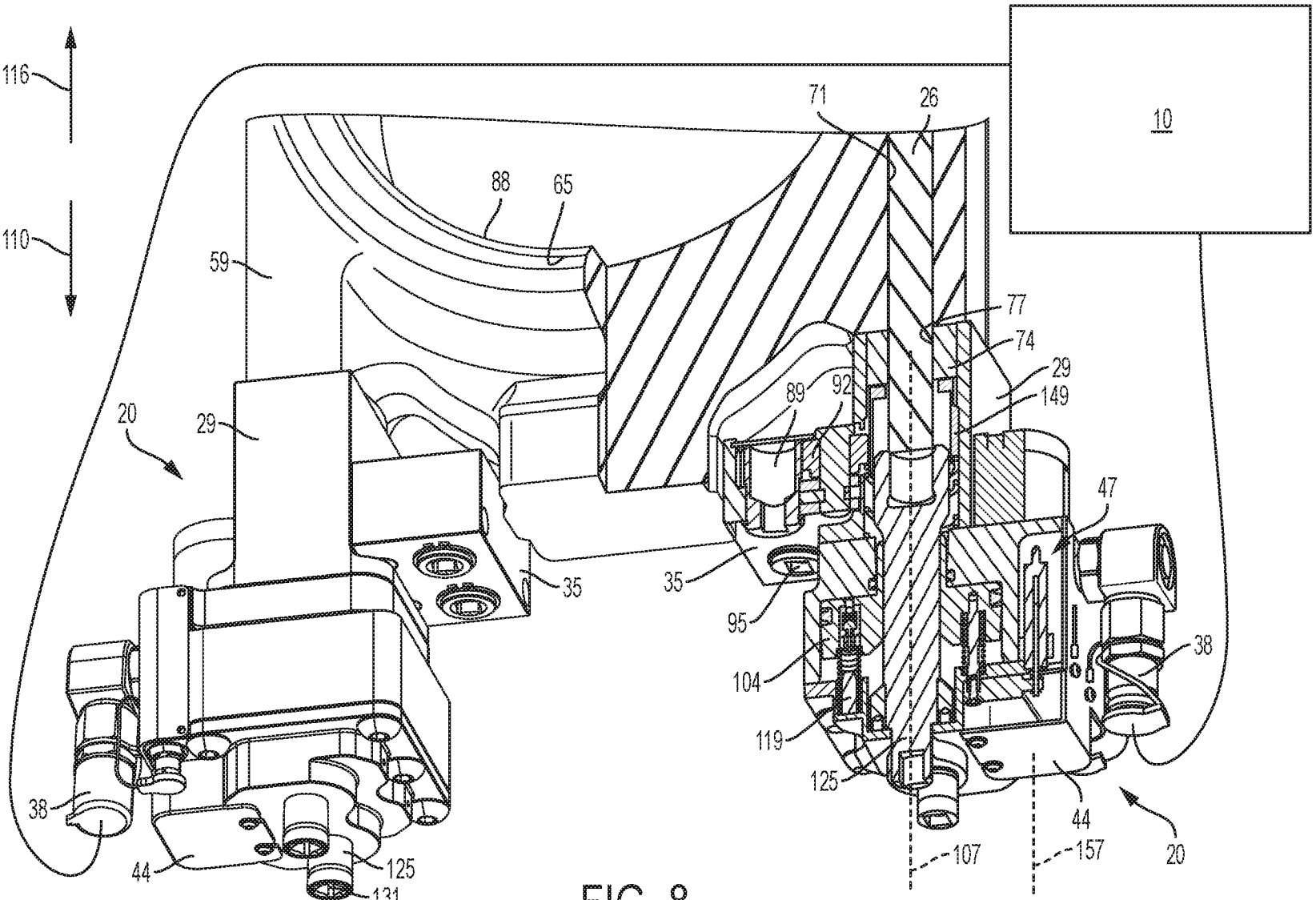
FIG. 8 is a partial cross-sectional view of the tensioning devices of FIG. 7 positioned adjacent the connecting rod, illustrating a puller assembly disengaged from a fastener.

In operation, more than one bolt 26 of the connecting rod 23 is synchronously tensioned by the hydraulic tensioner 20 to ensure a uniform clamping force across the joint between the cap portion 59 and the main arm 50 of the connecting rod 23, as shown in FIGS. 7 and 8. The uniform clamping force eliminates the gap 86 (FIG. 5) and exerts a bearing crush on the bearing 88 disposed within the second bearing aperture 65. In order to attach each hydraulic tensioner 20 to the connecting rod 23, each of the piston axes 107 are axially aligned with one of the corresponding bolts 26. As shown in FIG. 8, two hydraulic tensioners 20 are coupled to the four bolts 26 of connecting rod 23 (that is, one tensioner 20 is coupled to the pair of bolts 26 on each side of the connecting rod 23). In the illustrated embodiment, one pump system 10 (FIG. 8) is connected to the fluid inlet 38 of each hydraulic tensioner 20 so that each chamber 98 is similarly pressurized. Accordingly, the tensile load exerted on each bolt 26 is also substantially similar. In other embodiments, each tensioner 20 may be connected to separate pump systems 10.

As shown in FIGS. 7 and 8, before each hydraulic tensioner 20 is positioned on the connecting rod 23, the pulling members 125 move in direction 110 (e.g., due to gravity) so that the drive socket ends 134 extend beyond the main body 29 of each hydraulic tensioner 20. A tool (not shown) is individually inserted into the socket drive 131 of each pulling member 125 to rotate each pulling member 125 about its respective piston axis 107, thereby threading the threaded aperture 137 (FIG. 6) of each pulling member 125 onto the external threaded region 80 of each bolt 26. Each pulling member 125 is threadably secured to an associated bolt 26, as illustrated in FIG. 8.

Figure 9:
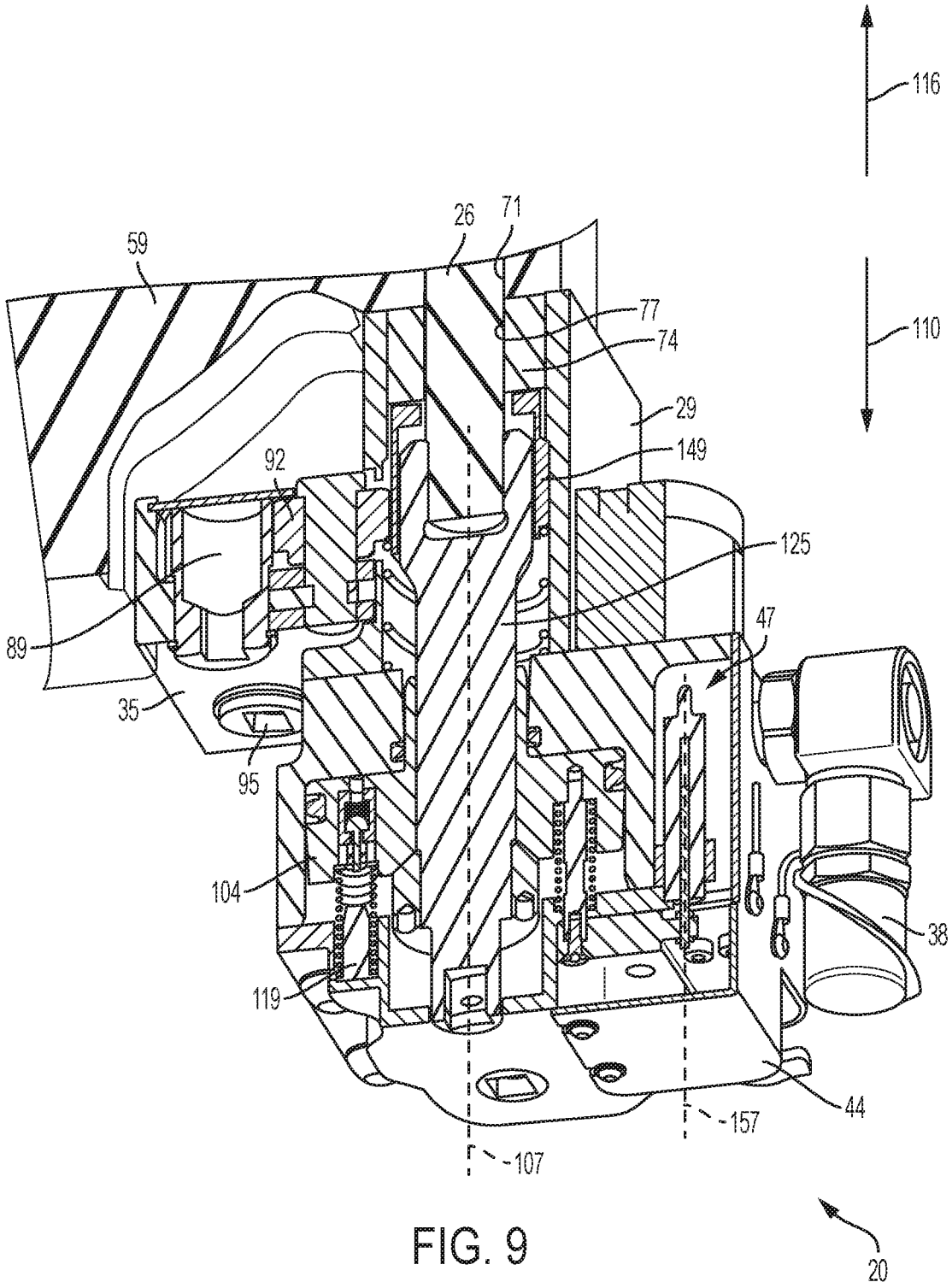
FIG. 9 is a partial cross-sectional view of the tensioning device of FIG. 7 positioned adjacent the connecting rod, illustrating the puller assembly engaged with the fastener.

FIG. 9 illustrates one of the pulling members 125 secured to an associated bolt 26. The pump system 10 provides pressurized fluid to the fluid inlet 38, and the fluid is directed to the chamber 98 adjacent the first side 102 of the piston 104. As fluid enters the chambers 98, the piston 104 moves from the first position (FIG. 9) toward the second position (FIG. 10) along the piston axis 107.

Figure 10:
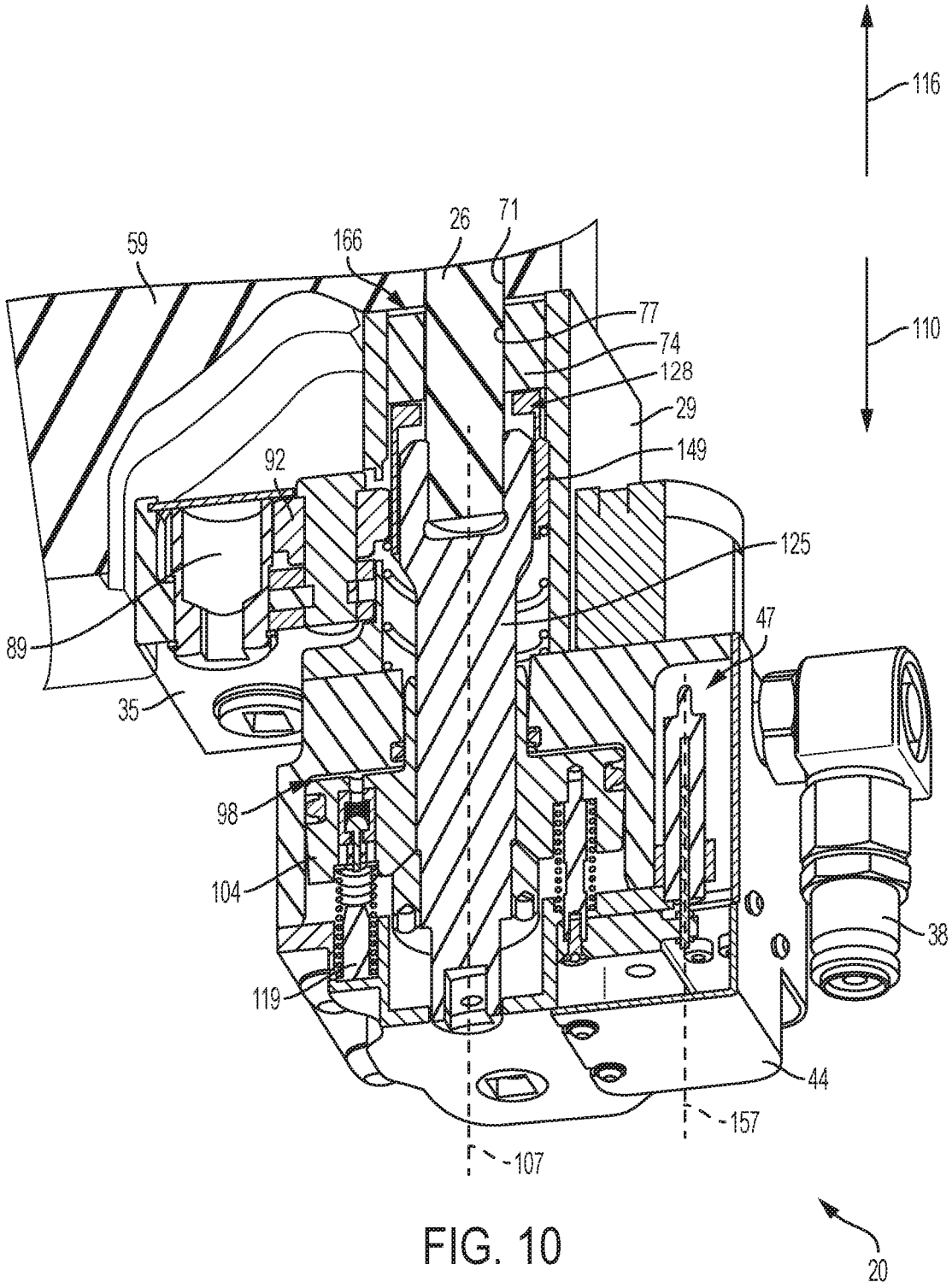
FIG. 10 is a partial cross-sectional view of the tensioning device of FIG. 7 positioned adjacent the connecting rod, illustrating the puller assembly engaged with the fastener.
Figure 11:
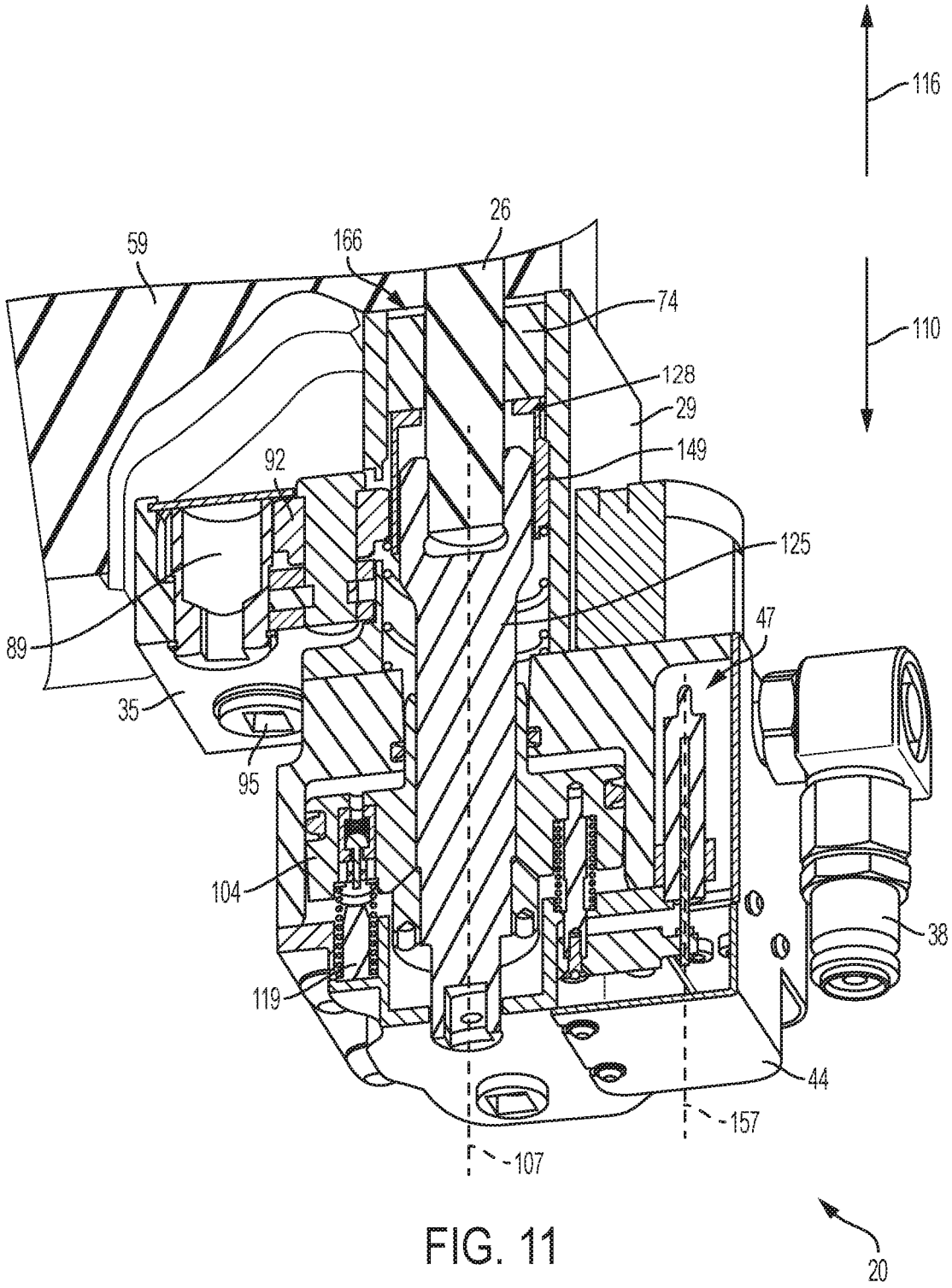
FIG. 11 is a partial cross-sectional view of the tensioning device positioned adjacent the connecting rod, illustrating the puller assembly engaged with the fastener.

As shown in FIG. 10, the piston 104 abuts the collar 146 of the pulling member 125, thereby driving the pulling member 125 in direction 110 along the piston axis 107 as well. As a result, the pulling member 125 applies tension to the bolt 26. As the bolt 26 stretches, a gap or space 166 (only one of which is shown in FIG. 10) is formed between the nut 74 and the cap portion 59 of the connecting rod 23. Meanwhile, because the sensor 47 is coupled to the piston 104 via the offset arm 160 (FIG. 6), the sensor 47 detects the displacement of the piston 104. In the illustrated embodiment, the sensor 47 generates and transmits a signal to the controller 169 (FIG. 6A), which then determines or calculates the tension exerted on the bolt 26 based on the measured displacement of the piston 104. In the illustrated embodiment, the initial pressurization shown in FIG. 10 corresponds to an initial pull that is applied to achieve the bearing crush or compaction. Once this is done, additional pressure is applied to the piston 104 to achieve a desired tensile load in the bolts 26.

Figure 12:
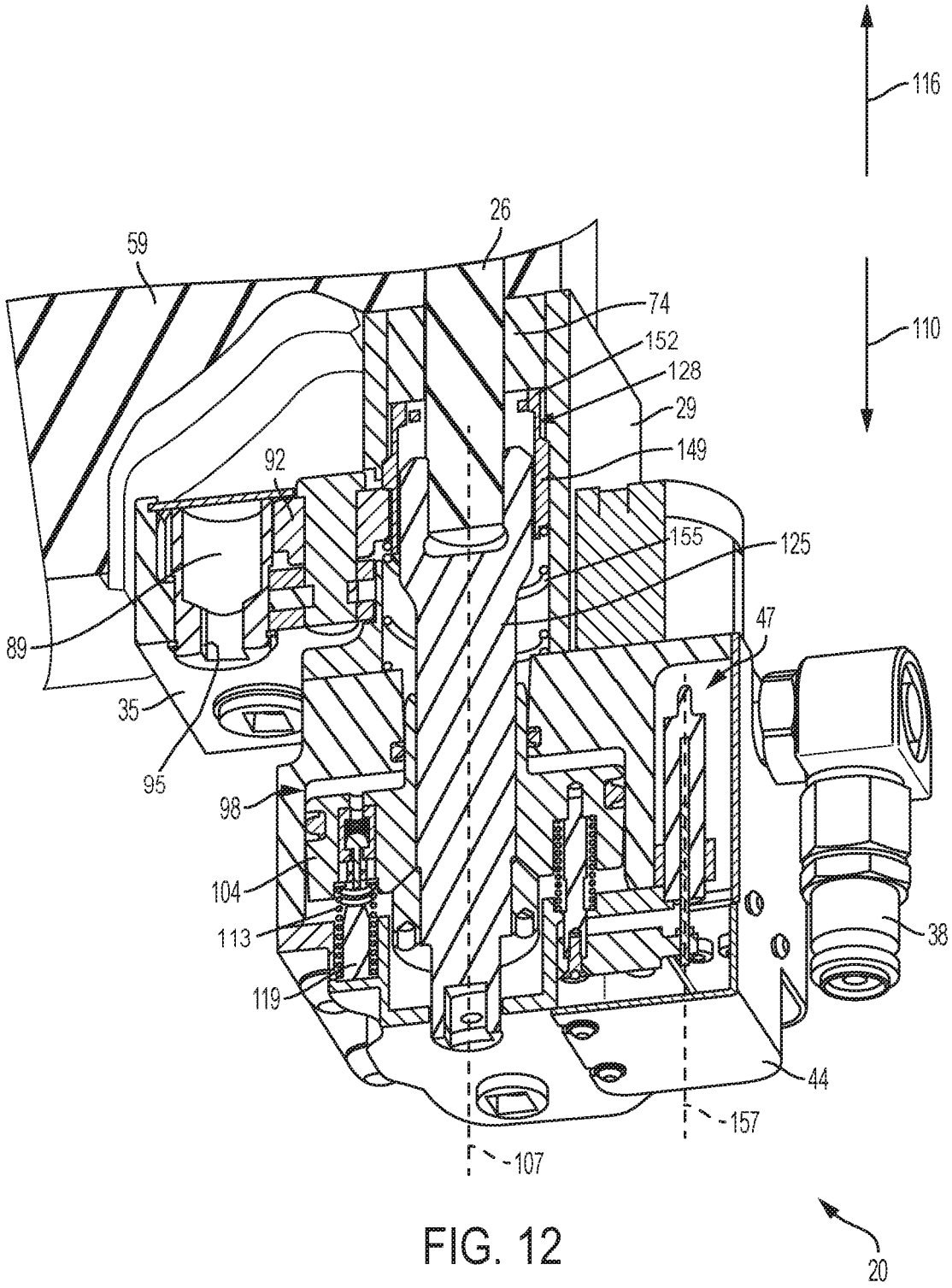
FIG. 12 is a partial cross-sectional view of the tensioning device positioned adjacent the connecting rod, illustrating the puller assembly engaged with the fastener.

The space 166 between the nut 74 and the cap portion 59 of the connecting rod 23 may increase as the pressure in the chamber 98 increases. As shown in FIG. 12, when the pressure in the chamber 98 corresponds to the desired tensile stress of the bolt 26, the nut 74 is rotated via the socket 128 until the nut 74 abuts the cap portion 59. The nut 74 may be rotated by inserting a tool (not shown) into the drive socket 95 to rotate the drive gear 89. Rotation of the drive gear 89 rotates the driven gear 92 which subsequently rotates the socket 128. The castellations 152 of the socket 128 are biased into engagement with the castellations 83 (FIG. 5) of the nut 74 via the spring 155, and the socket 128 transmits torque to the nut 74 when rotated. The amount of torque required to thread the nut 74 in direction 116 is relatively small because the nut 74 rotates freely along the bolts 26 when the space 166 is present. Furthermore, due to the space 166 between the nut 74 and the cap portion 59, there is little friction generated at the interface between the nut 74 and the cap portion 59.

Figure 13:
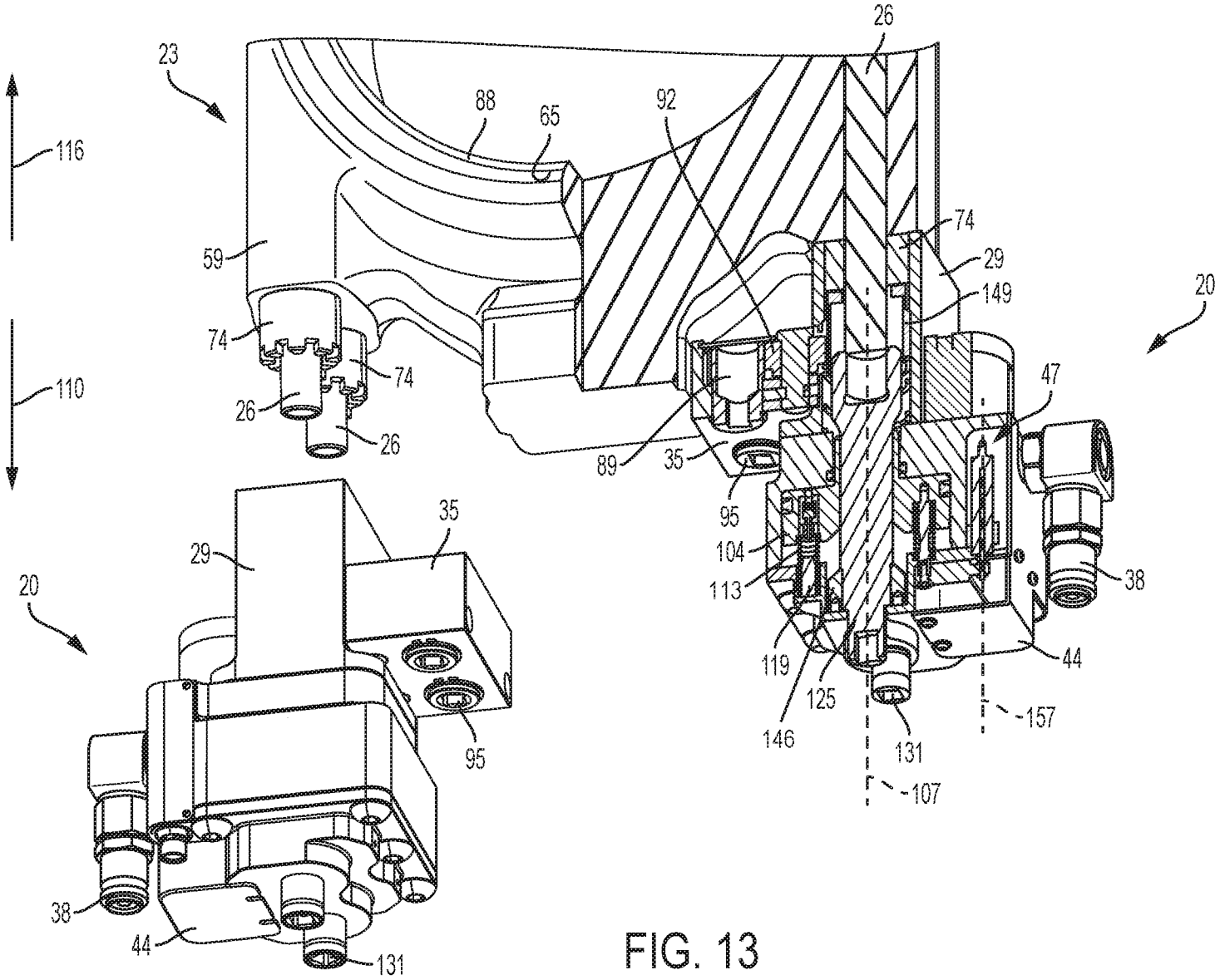
FIG. 13 is a partial cross-sectional view of the tensioning devices being removed from the connecting rod.

As shown in FIG. 13, after the nut 74 abuts the cap portion 59 and the bolt 26 has been tensioned, the pump system 10 is disconnected from the hydraulic tensioner 20. Prior to disconnecting the pump system 10, the pressurized fluid is removed from the chamber 98 (FIG. 12), and the biasing members 113 move the piston 104 from the second position toward the first position in the direction 116 along the piston axis 107. The pulling member 125 remains in place due to the threaded connected between the pulling member 125 and the tensioned bolt 26 and because the piston 104 does not engage the collar 146 as it moves in the direction 116. In other words, the piston 104 moves relative to the pulling member 125 when the chamber 98 is depressurized. At this point, the pulling members 125 are unthreaded from the bolts 26 and the hydraulic tensioner 20 may be uncoupled from the connecting rod 23.

Figure 14:
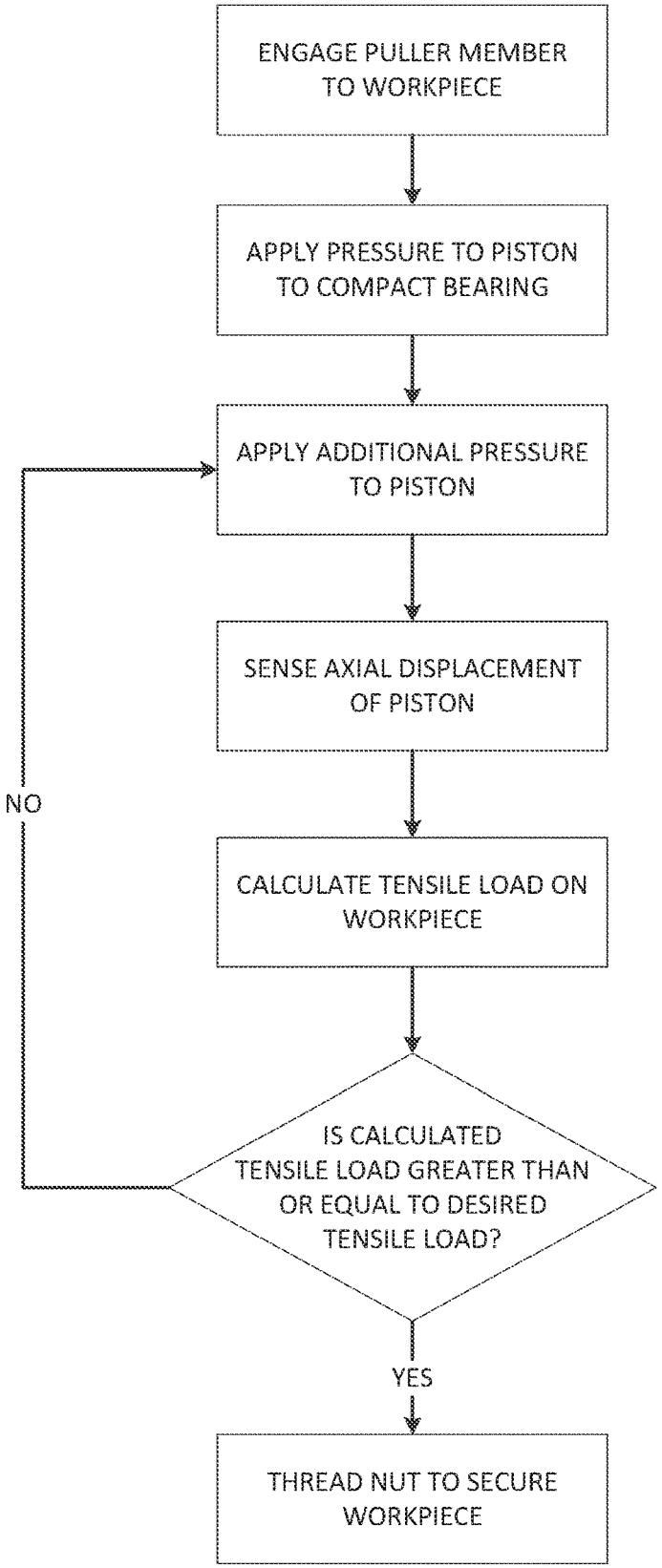
FIG. 14 is a block diagram of a method of operating a tensioning device according to one embodiment.

FIG. 14 illustrates a block diagram of the operation of the tensioner 20. After the puller member(s) 125 (FIG. 9) are secured to the workpiece (e.g., respective bolts 26), pressurized fluid is applied to the chamber 98 (FIG. 9) adjacent the first side 102 of the piston 104 moving the piston 104 along the piston axis 107. As described above, in the illustrated embodiment, a first pressure may be initially applied to the piston 104 compact the bearing, and subsequently additional pressure may be applied to achieve a desired tensile load. The sensor 47 (FIG. 12) detects the displacement of the piston 104. As shown in The tension exerted on the bolt 26 can be determined (e.g., by a controller) based on the measured displacement of the piston 104. In some embodiments, the sensor 47 generates signals corresponding to the magnitude of displacement and transmits the signals to the controller or external device The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. A tensioning device for tensioning a workpiece, the tensioning device comprising:

a main body having a chamber;

a fluid inlet providing fluid communication between a fluid source and the chamber;

a puller member supported in the main body and configured to engage the workpiece;

a piston positioned in the chamber and coupled to the puller member, movement of the piston moving the puller member along a piston axis in at least a first direction, the piston including a peripheral portion radially spaced apart from the piston axis;

a socket movable relative to the puller member and biased toward the workpiece, the puller member and the socket being supported for movement relative to the main body in a direction parallel to the piston axis and being supported for rotational movement, an end surface of the socket including castellations engageable with an end surface of a nut that is threadably coupled to the workpiece; and a sensor including a movable member coupled to the peripheral portion of the piston by an offset arm, the sensor operative to measure a displacement of at least one of the piston and the puller member in a direction parallel to the piston axis, the sensor generating a signal indicative of the displacement to facilitate calculation of a tensile load exerted on the workpiece based on the sensed displacement.

2. The tensioning device of claim 1, wherein the sensor is a potentiometer.

3. The tensioning device of claim 1, wherein the sensor includes a housing and the movable member is supported for movement relative to the housing, wherein the offset arm oriented perpendicular to the piston axis.

4. The tensioning device of claim 1, wherein the puller member further includes an indicator to provide a visual indication when the piston has extended beyond a predetermined stroke length.

5. The tensioning device of claim 1, wherein the main body is configured to engage a first portion of the workpiece while the puller member engages and exerts a tensile force on a second portion of the workpiece.

6. The tensioning device of claim 1, wherein the puller member is selectively threadably coupled to the workpiece, wherein the socket is coupled to the nut and driven to thread the nut along the workpiece.

7. The tensioning device of claim 1, wherein the socket is driven by a gear train including a drive socket that receives a tool in order to drive the gear train.

8. The tensioning device of claim 1, further comprising a relief valve in communication with the chamber to relieve fluid pressure exerted on the piston once the piston reaches a predetermined stroke length.

9. The tensioning device of claim 1, further comprising a return spring for biasing the piston in a second direction along the piston axis, the return spring engages the peripheral portion of the piston and is positioned around a member by which the offset arm is coupled to the piston.

10. The tensioning device of claim 1, wherein the chamber is a first chamber, the puller member is a first puller member, the piston is a first piston, and the sensor is a first sensor, wherein the tensioning device further includes a second puller member supported in the main body and configured to engage the workpiece;

a second piston positioned in a second chamber of the main body and coupled to the second puller member, movement of the second piston moving the second puller member along a second piston axis in at least a first direction; and a second sensor coupled to the second piston and operative to measure displacement of at least one of the second piston and the second puller member in a direction parallel to the second piston axis, the second sensor generating a signal indicative of the displacement.

11. The tensioning device of claim 10, wherein the first piston and the second piston move synchronously, the second piston moving along a second piston axis parallel to the first piston axis.

12. A tensioning device for tensioning a workpiece, the tensioning device comprising:

a main body having a chamber;

a fluid inlet providing fluid communication between a fluid source and the chamber;

a puller member supported in the main body and configured to engage the workpiece;

a piston positioned in the chamber and coupled to the puller member, movement of the piston moving the puller member along a piston axis in at least a first direction;

a socket movable relative to the puller member and biased toward the workpiece, the puller member and the socket being supported for movement relative to the main body in a direction parallel to the piston axis and being supported for rotational movement, an end surface of the socket including castellations engageable with an end surface of a nut that is threadably coupled to the workpiece; and a sensor operative to measure a displacement of the piston in a direction parallel to the piston axis to facilitate calculation of a tensile load exerted on the workpiece based on the sensed displacement, the sensor including a housing and a movable member supported for movement relative to the housing along a sensor axis substantially parallel to and offset from the piston axis, the movable member coupled to the piston by an offset arm oriented perpendicular to the piston axis.

13. The tensioning device of claim 12, wherein the puller member is selectively threadably coupled to the workpiece, wherein the socket is coupled to a nut and driven to thread the nut along the workpiece.

14. The tensioning device of claim 12, wherein the puller member further includes an indicator to provide a visual indication when the piston has extended beyond a predetermined stroke length.

* * * * *